US006846041B1

(12) United States Patent
Tseng

(10) Patent No.: US 6,846,041 B1
(45) Date of Patent: Jan. 25, 2005

(54) CHAIR WITH A PAIR OF INCLINATION-PREVENTING MEMBERS

(75) Inventor: Chun-Hsien Tseng, No. 3, Ting-Hsi-Hsin, Lu-Man Tsun, Chu-Chi Hsiang, Chiayi Hsien (TW)

(73) Assignee: Chun-Hsien Tseng, Chiayi Hsien (TW)

( * ) Notice: Subject to any disclaimer, the term of this patent is extended or adjusted under 35 U.S.C. 154(b) by 0 days.

(21) Appl. No.: 10/641,870

(22) Filed: Aug. 15, 2003

(51) Int. Cl.[7] ..... A47C 4/00
(52) U.S. Cl. ..... 297/35; 297/45; 297/46
(58) Field of Search ..... 297/45, 35, 36, 297/16.1, 53; 108/118; 248/439, 150

(56) References Cited

U.S. PATENT DOCUMENTS 1,957,417 A * 5/1934 Williams ..... 297/35
3,851,914 A * 12/1974 Nii ..... 297/45
3,941,416 A * 3/1976 Uchida ..... 297/45
4,200,331 A * 4/1980 Uchida ..... 297/45
4,787,671 A * 11/1988 Wilson ..... 297/35
5,058,950 A * 10/1991 Mann ..... 297/45
5,507,548 A * 4/1996 Marhefka ..... 297/45
6,601,912 B1 * 8/2003 Chen ..... 297/45
6,634,705 B1 * 10/2003 Zheng ..... 297/41

* cited by examiner

*Primary Examiner*—Peter M. Cuomo
*Assistant Examiner*—Sarah C. Burnham
(74) *Attorney, Agent, or Firm*—Webb Ziesenheim Logsdon Orkin & Hanson, P.C.

(57) ABSTRACT

A chair includes two armrest units and a leg assembly. The leg assembly comprises a front leg unit having a pair of front legs pivoted to each other, and a rear leg unit having a pair of rear legs pivoted to each other, and being operable to be disposed in one of a folded state and an extended state. Each armrest unit includes an armrest with two opposite ends respectively pivoted to a respective one of the front legs and a respective one of the rear legs. A seat unit is connected to the armrest units. A pair of inclination-preventing members project respectively from the armrest units and abut against the front and rear leg units, respectively, when the leg assembly is disposed at the extended state.

3 Claims, 6 Drawing Sheets

CHAIR WITH A PAIR OF INCLINATION-PREVENTING MEMBERS

BACKGROUND OF THE INVENTION

1. Field of the Invention

The invention relates to a chair, more particularly to a chair with a pair of inclination-preventing members for preventing inclination of armrest units relative to a seat unit.

2. Description of the Related Art

Referring to FIGS. 1 to 3, a conventional chair is shown to include a leg assembly, a pair of armrest units 12, and a seat unit 14.

As illustrated, the leg assembly includes a front leg unit 11 having a pair of front legs 111 pivoted to each other, and a rear leg unit 11 having a pair of rear legs 112 pivoted to each other. The leg assembly is operable from a folded state of FIG. 2 to an extended state of FIG. 1, in which, the front legs 111 cross each other and the rear legs 112 cross each other. Each of the armrest units 12 includes an armrest 120 with two opposite ends, and two pivot seats 15 extending respectively and downwardly from the opposite ends of the armrest 120 and pivoted to the top end of a respective one of the front legs 111 and the top end of a respective one of the rear legs 112. The seat unit 14 is disposed between and is connected to the armrest units 12.

The conventional chair is disadvantageous in that the armrest units 12 undesirably incline toward the seat unit 14, as best shown in FIG. 3, due to the weight (W) of a seated person (not shown), thereby discomforting the seated person.

SUMMARY OF THE INVENTION

The object of the present invention is to provide a chair with a pair of inclination-preventing members that can prevent inclination of armrest units so as to overcome the aforesaid disadvantage of the prior art.

Accordingly, the chair of this invention includes: a leg assembly including a front leg unit having a pair of front legs pivoted to each other and having top ends, and a rear leg unit having a pair of rear legs pivoted to each other and having top ends, the leg assembly being operable to be disposed in one of a folded state and an extended state, the front legs crossing each other and the rear legs crossing each other when the leg assembly is in the extended state; a pair of armrest units, each of which includes an armrest with two opposite ends respectively pivoted to the top end of a respective one of the front legs and the top end of a respective one of the rear legs; a seat unit disposed between and connected to the armrest units; and a pair of inclination-preventing members projecting respectively from the armrest units toward the front and rear leg units, the inclination-abutting members abutting against the front and rear leg units, respectively, when the leg assembly is disposed in the extended state, thereby preventing inclination of the armrests of the armrest units toward the seat unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
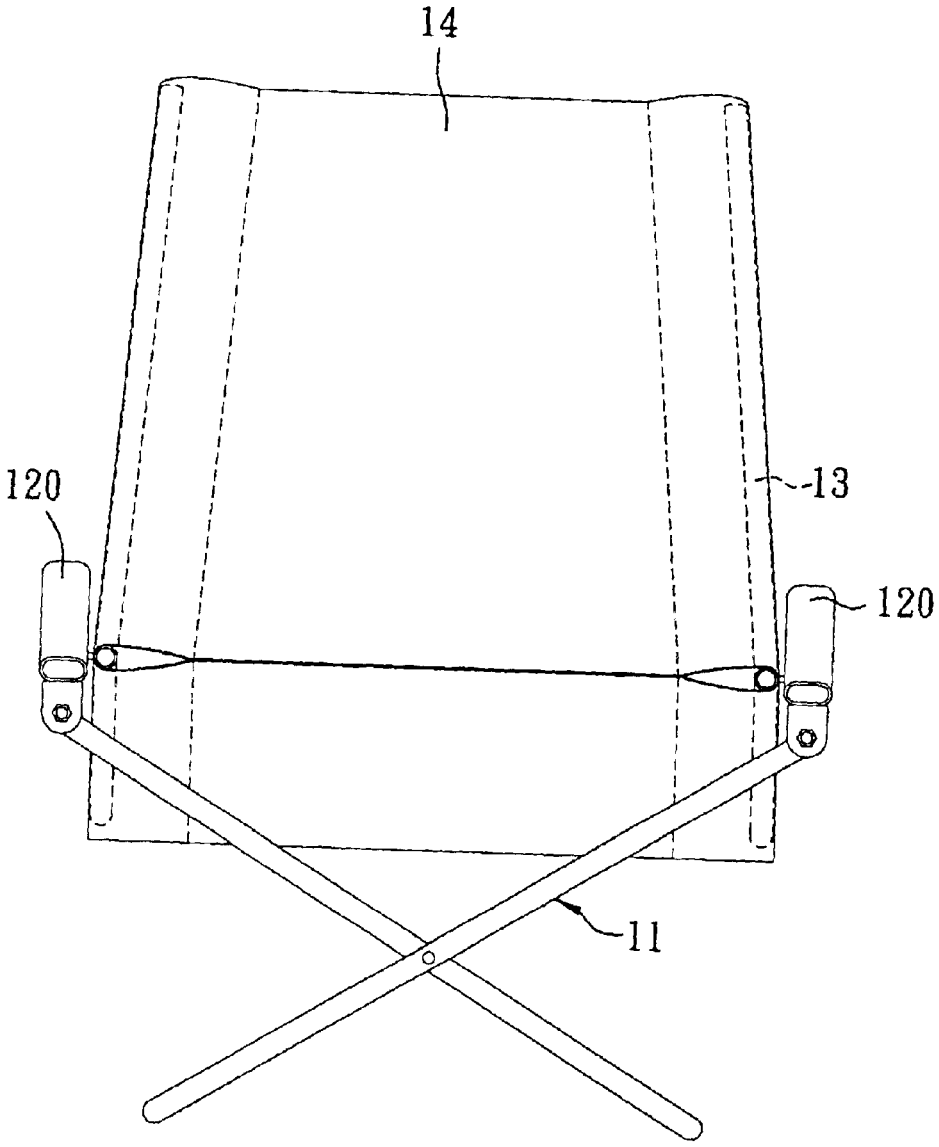
FIG. 1 PRIOR ART
FIG. 1 is a schematic front view of a conventional chair in an extended state.
Figure 2:
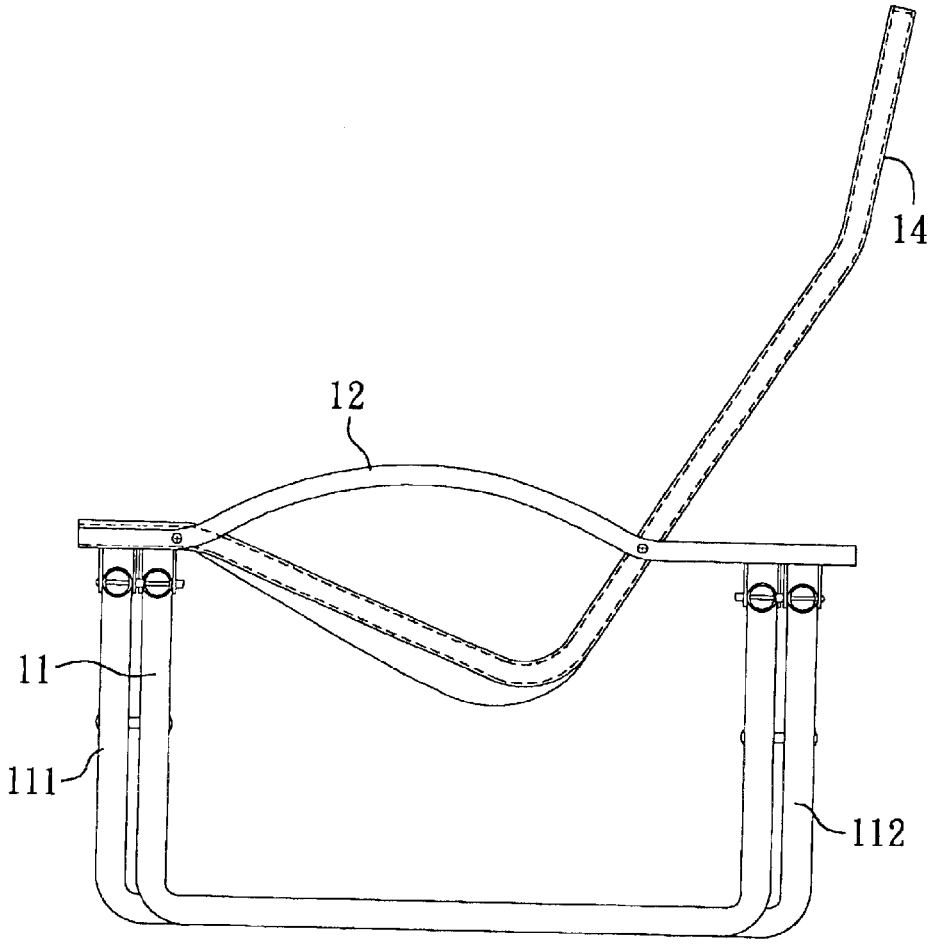
FIG. 2 PRIOR ART
FIG. 2 is a schematic side view of the conventional chair in the extended state.
Figure 3:
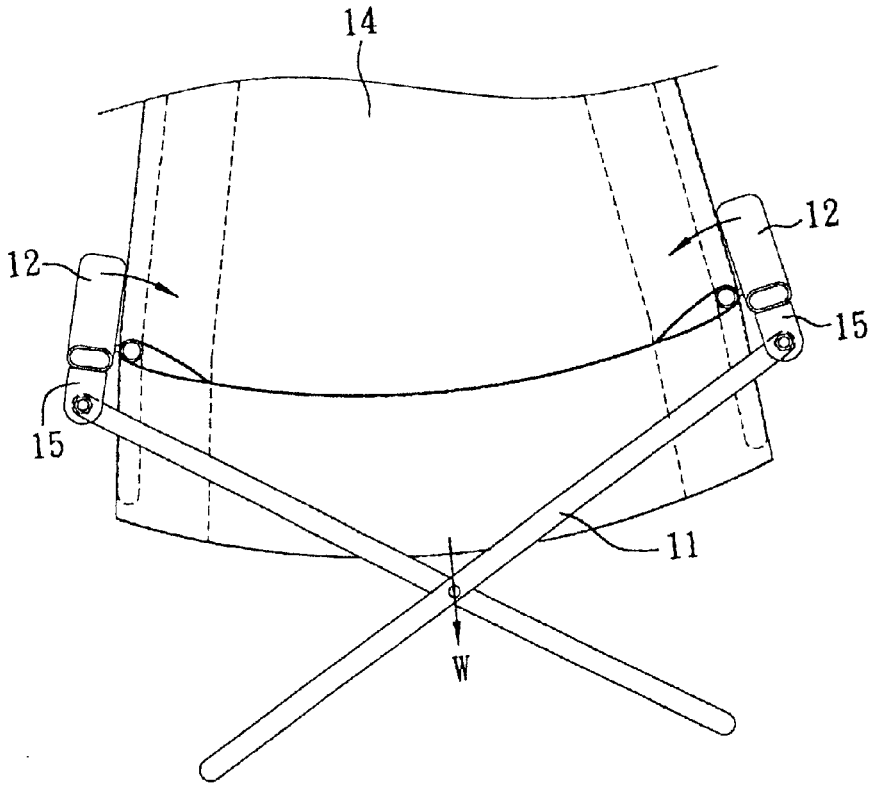
FIG. 3 PRIOR ART
FIG. 3 is a fragmentary front view of the conventional chair, illustrating how two armrest units incline inwardly relative to a leg assembly due to exertion of a force thereon.
Figure 4:
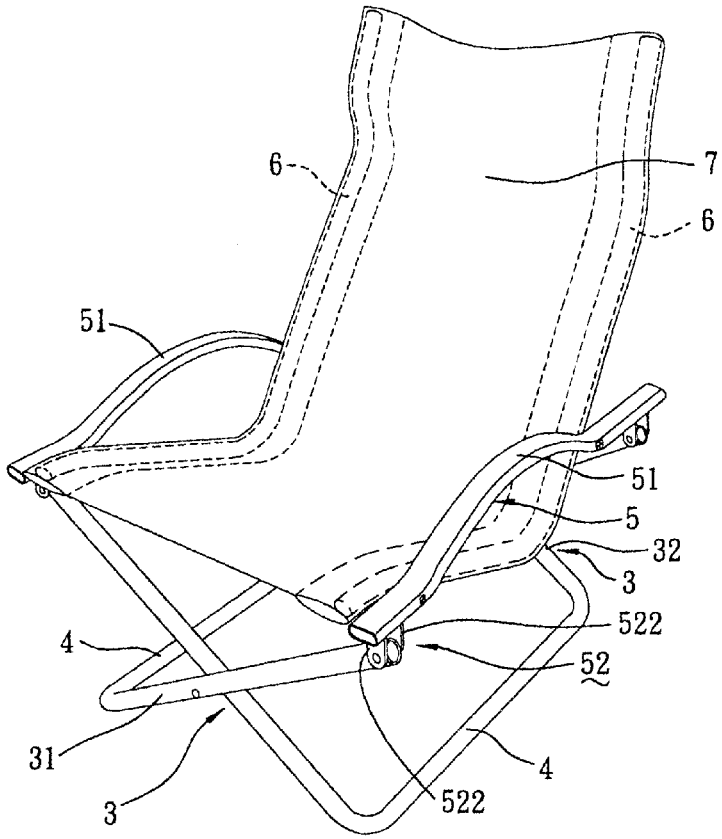
FIG. 4 is a perspective view of the preferred embodiment of a chair according to the present invention.
Figure 5:
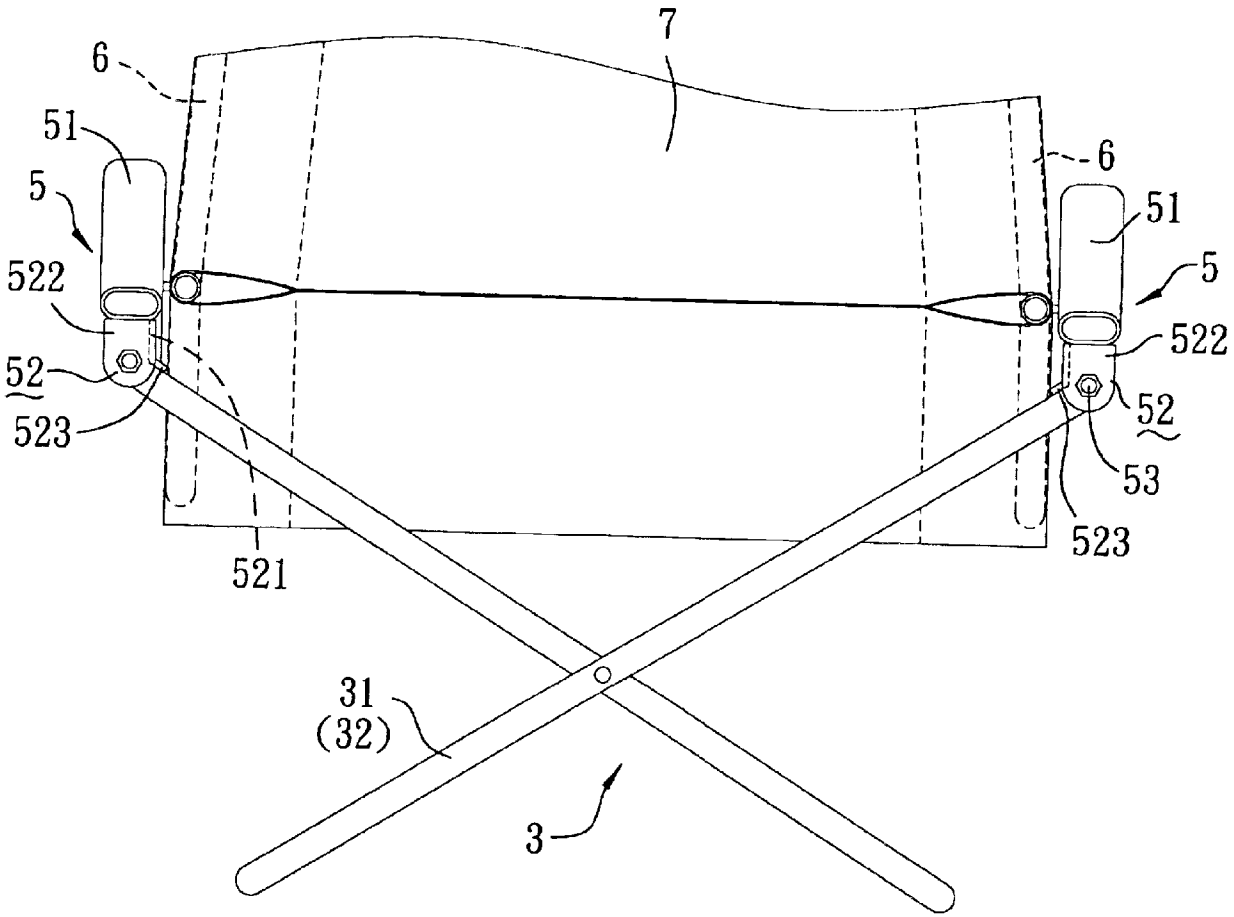
FIG. 5 is a schematic fragmentary front view of the preferred embodiment.

Referring to FIGS. 4 and 5, the preferred embodiment of a chair according to the present invention is shown to include a leg assembly, a pair of armrest units 5, a seat unit, and a pair of inclination-preventing members 523".

As illustrated, the leg assembly includes a front leg unit 3 having a pair of front legs 31 pivoted to each other, a rear leg unit 3 having a pair of rear legs 32 pivoted to each other, and left and right connecting rods 4 each of which interconnects a bottom end of a respective one of the front legs 31 and a bottom end of a respective one of the rear legs 32 in such a manner that the front legs 31 are pivotable relative to each other and the rear legs 32 are pivotable relative to each other, thereby disposing the leg assembly in one of a folded state and an extended state. In the extended state, the front legs 31 cross each other and the rear legs 32 cross each other, as best shown in FIG. 4.

Each of the armrest units 5 includes an armrest 51 with two opposite ends pivoted to a top end of a respective one of the front legs 31 and a top end of a respective one of the rear legs 32.

The seat unit includes a pair of generally L-shaped canvas-holding rods 6 which are disposed between and which are respectively connected to the armrests 51, and a canvas 7 that has two opposite ends fastened respectively and detachably to the canvas-holding rods 6 so as to prevent collapse of the armrests 51 when the leg assembly is disposed in the extended state.

The inclination-preventing members 523" project from the armrest units 5 toward the front and rear leg units 3, and abut against the front and rear leg units 3, respectively, when the leg assembly is disposed in the extended state, thereby preventing inclination of the armrests 51 of the armrest units 5 toward the seat unit.

Figure 6:
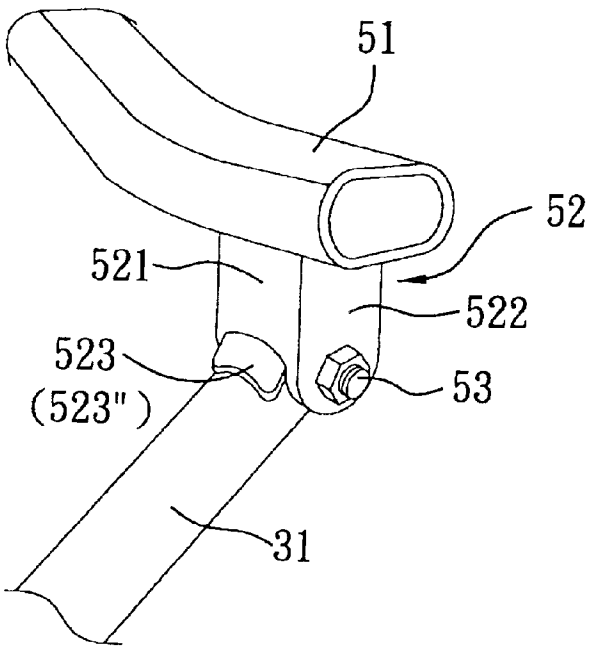
FIG. 6 is a fragmentary perspective view, illustrating how an armrest unit is prevented from inclining inwardly relative to a leg assembly of the preferred embodiment.

Referring to FIG. 6, each of the armrest units 5 further includes a pair of pivot seats 52 which project downwardly and respectively from the opposite ends of a respective one of the armrests 51, and each of which includes front and rear plates 522 sandwiching and pivoted to the top end of a respective one of the front and rear legs 31,32 through a pivot shaft 53, and a side plate 521 that interconnects the front and rear plates 522. Each of the inclination-preventing members 523" includes a pair of curved plates 523, each of which projects laterally and outwardly from a lower end of the side plate 521 of a respective one of the pivot seats 52 to abut against a respective one of the front and rear legs 31,32 when the leg assembly is disposed in the extended state.

Since the curved plates 523 prevent inward inclination of the armrest 51 relative to the seat unit, the aforesaid disadvantage of the prior art is accordingly overcome.

With this invention thus explained, it is apparent that numerous modifications and variations can be made without departing from the scope and spirit of this invention. It is therefore intended that this invention be limited only as indicated in the appended claims.

I claim:

1. A chair comprising:

a leg assembly including a front leg unit having a pair of front legs pivoted to each other and having top ends and bottom ends, and a rear leg unit having a pair of rear legs pivoted to each other and having top ends and bottom ends, said leg assembly being operable to be disposed in one of a folded state and an extended state, said front legs crossing each other and said rear legs crossing each other when said leg assembly is disposed in said extended state;

a pair of armrest units, each of which includes an armrest with two opposite ends respectively pivoted to said top end of a respective one of said front legs and said top end of a respective one of said rear legs;

a seat unit disposed between and connected to said armrest units; and a pair of inclination-preventing members projecting from said armrest units toward said front and rear leg units, said inclination-preventing members abutting against said front and rear leg units, respectively, when said leg assembly is disposed in said extended state, thereby preventing inclination of said armrests of said armrest units toward said seat unit.

2. The chair as defined in claim 1, wherein said leg assembly further includes left and right connecting rods, each of which interconnects said bottom end of a respective one of said front legs and said bottom end of a respective one of said rear legs.

3. The chair as defined in claim 1, wherein each of said armrest units further includes a pair of pivot seats which project downwardly and respectively from said opposite ends of said armrest of a respective one of said armrest units and each of which includes front and rear plates sandwiching and pivoted to said top end of the respective one of said front and rear legs, and a side plate that interconnects said front and rear plates and that has a lower end, each of said inclination-preventing members including a pair of curved plates, each of which projects from said lower end of said side plate of a respective one of said pivot seats to abut against a respective one of said front and rear legs when said leg assembly is disposed in said extended state.

* * * * *